US009632462B2

(12) United States Patent
Yamane

(10) Patent No.: US 9,632,462 B2
(45) Date of Patent: Apr. 25, 2017

(54) FIXING DEVICE AND IMAGE FORMING APPARATUS INCLUDING THE SAME

(71) Applicant: KYOCERA Document Solutions Inc., Osaka (JP)

(72) Inventor: Shinji Yamane, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/132,537

(22) Filed: Apr. 19, 2016

(65) Prior Publication Data

US 2016/0313678 A1 Oct. 27, 2016

(30) Foreign Application Priority Data

Apr. 24, 2015 (JP) ..... 2015-089072

(51) Int. Cl.
*G03G 15/20* (2006.01)

(52) U.S. Cl.
CPC ..... *G03G 15/2017* (2013.01)

(58) Field of Classification Search
CPC ..... G03G 15/2017; G03G 15/2089; G03G 15/2064
USPC ..... 399/331, 328
See application file for complete search history.

(56) References Cited

U.S. PATENT DOCUMENTS

2005/0111892 A1* 5/2005 Mitsuoka ..... G03G 15/2064 399/328
2007/0116501 A1* 5/2007 Inoue ..... G03G 15/2057 399/328
2014/0029992 A1* 1/2014 Yamamoto ..... G03G 15/2064 399/328

FOREIGN PATENT DOCUMENTS

JP 2002-244472 8/2002

* cited by examiner

*Primary Examiner* — Sandra Brase
(74) *Attorney, Agent, or Firm* — Wenderoth, Lind & Ponack, L.L.P.

(57) ABSTRACT

An electricity removing unit 50 includes a rotating roller part 51, a brush part 52, a driving part, and a restraint member. The brush part 52 includes a plurality of conductive fiber bristles 52*a* having base end portions connected to a peripheral surface of the rotating roller part 51. The driving part rotationally drives the rotating roller part 51. The restraint member abuts the brush part 52 from a rotation downstream side, thereby inclining the plurality of conductive fiber bristles 52*a* to an upstream side from a downstream side of a rotational direction toward a radial outside and thus reforming them. In this way, the restraint member restrains a distance between a front end of each conductive fiber bristle 52*a* and the peripheral surface of the rotating roller part 51 to a setting distance set in advance.

4 Claims, 6 Drawing Sheets

FIXING DEVICE AND IMAGE FORMING APPARATUS INCLUDING THE SAME

CROSS-REFERENCE TO RELATED APPLICATION

This application is based upon and claims the benefit of priority from Japanese Patent Application No. 2015-089072 filed on Apr. 24, 2015, the entire contents of which are incorporated herein by reference.

BACKGROUND

The technology of the present disclosure relates to a fixing device including a fixing roller, a pressure roller brought into press contact with the fixing roller, and an electricity removing unit for removing charge of a surface of the pressure roller, and an image forming apparatus including the fixing device.

In an electrophotographic image forming apparatus, a thermal roller type fixing device, in which a fixing roller having a heater therein and a pressure roller are brought into press contact with each other such that a paper carrying an unfixed toner image passes through between these rollers so that toner is fixed to the paper, has been widely used.

In such a fixing device, each of the fixing roller and the pressure roller has a release layer of a fluororesin and the like on the surface thereof. Therefore, due to frictional electrification between these two rollers at the time of rotational driving of the fixing roller and the pressure roller, charge transfer when a paper subjected to transfer passes through a fixing nip, and the like, the surface of each roller is easy to be charged, so that the surface of the pressure roller may be charged to minus several thousands of voltages. As a consequence, when a charging polarity of unfixed toner on a paper is negative, there is a problem that the unfixed toner moves to the surface of the fixing roller by repulsive force from the surface of the pressure roller. Furthermore, when the charging polarity of the unfixed toner is positive, negative charge leaks at the fixing nip, so that electrostatic attractive force of the unfixed toner for a paper is reduced and thus the unfixed toner moves to the surface of the fixing roller. When the toner having moved to the surface of the fixing roller is attached to the paper again, the image quality of a fixed image is degraded.

In this regard, a technology, in which a conductive brush including a plurality of conductive fiber bristles is arranged in the vicinity of the pressure roller and discharge occurs between a front end of each conductive fiber bristle and the surface of the pressure roller so that negative charge on the surface of the pressure roller is removed, has been proposed. Between the front end of each conductive fiber bristle and the surface of the pressure roller, a space is provided to cause the discharge.

SUMMARY

A fixing device according to one aspect of the present disclosure includes a fixing roller, a pressure roller, and an electricity removing unit. The pressure roller is brought into press contact with the fixing roller. The electricity removing unit removes charge charged on a surface of the pressure roller.

The aforementioned electricity removing unit includes a rotatable rotating roller part, a brush part, a driving part, and a restraint member. The brush part includes a plurality of conductive fiber bristles having base end portions connected to a peripheral surface of the aforementioned rotating roller part. The driving part rotationally drives the aforementioned rotating roller part. The restraint member abuts the aforementioned brush part from a rotation downstream side, thereby inclining the aforementioned plurality of conductive fiber bristles to an upstream side from a rotation downstream side toward a radial outside and thus reforming them. In this way, the restraint member restrains a distance between a front end of each conductive fiber bristle and the peripheral surface of the rotating roller part to a setting distance set in advance.

An image forming apparatus according to another aspect of the present disclosure includes the aforementioned fixing device.

DETAILED DESCRIPTION

Hereinafter, an example of an embodiment will be described in detail on the basis of the drawings. It is noted that the technology of the present disclosure is not limited to the following embodiments.

Embodiment

Figure 1:
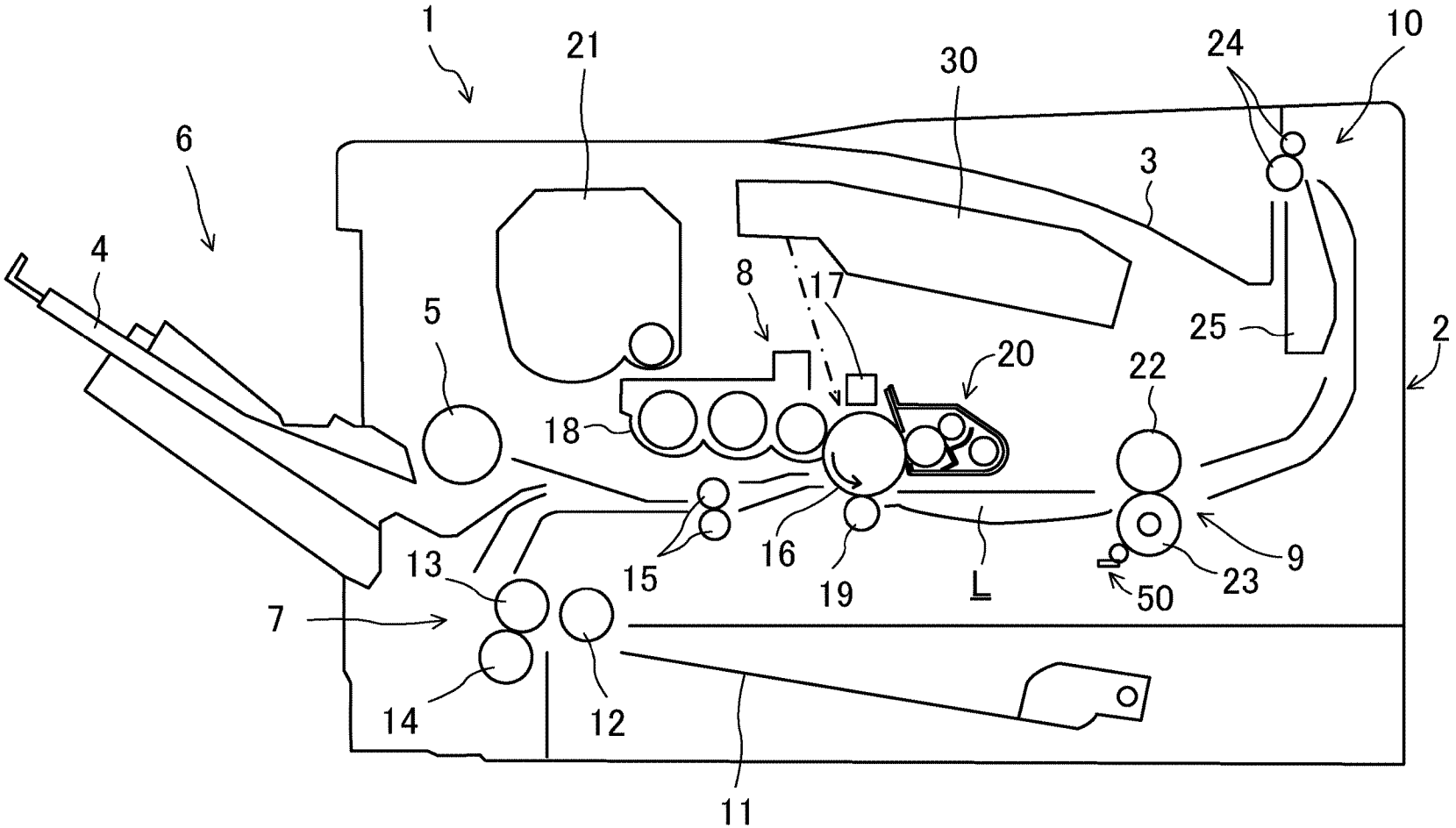
FIG. 1 is a schematic configuration diagram illustrating an image forming apparatus including a fixing device in an embodiment.

FIG. 1 illustrates a schematic configuration of a laser printer 1 which is an example of an image forming apparatus in the present embodiment. As illustrated in FIG. 1, the laser printer 1 includes a box-like printer body 2, a manual paper feeding unit 6, a cassette paper feeding unit 7, an image forming unit 8, a fixing device 9, and a paper discharge unit 10. The laser printer 1 is configured to form an image on a paper on the basis of image data transmitted from a terminal (not illustrated) and the like while conveying the paper along a conveyance path L in the printer body 2.

The manual paper feeding unit 6 has a manual tray 4 provided at one side portion of the printer body 2 so as to be openable and closable, and a manual paper feeding roller 5 provided in the printer body 2 so as to be rotatable.

The cassette paper feeding unit 7 is provided at a bottom portion of the printer body 2. The cassette paper feeding unit 7 includes a paper feeding cassette 11 that stores a plurality of papers P overlapped one another, a pick-up roller 12 that takes out the papers P in the paper feeding cassette 11 one by one, and a feed roller 13 and a retard roller 14 that separate the taken-out papers P one by one and send the separated paper to the conveyance path L.

The image forming unit 8 is provided above the cassette paper feeding unit 7 in the printer body 2. The image forming unit 8 includes a photosensitive drum 16 serving as an image carrying member provided in the printer body 2 so as to be rotatable, a charging device 17, a developing device 18, a transfer device 19, a cleaning part 20, and a laser scanning unit (LSU) 30 arranged above the photosensitive drum 16 to serve as an optical scanning device, wherein the charging device 17, the developing device 18, the transfer device 19, and the cleaning part 20 are arranged around the photosensitive drum 16. Accordingly, the image forming unit 8 is configured to form an image on the paper P supplied from the manual paper feeding unit 6 or the cassette paper feeding unit 7. It is noted that at the conveyance path L, a pair of resist rollers 15 are provided to temporarily keep the sent paper P waiting and then supply the paper P to the image forming unit 8 at a predetermined timing.

The fixing device 9 is arranged at a lateral side of the image forming unit 8. The fixing device 9 includes a fixing roller 22 and a pressure roller 23 brought into press contact with the fixing roller 22. The fixing roller 22 has a heater 22*a* (illustrated only in FIG. 2) therein. The fixing device 9 heats and presses a toner image transferred to the paper P in the image forming unit 8, thereby fixing the toner image to the paper P.

The paper discharge unit 10 is provided above the fixing device 9. The paper discharge unit 10 includes a paper discharge tray 3, a pair of paper discharge rollers 24 for conveying the paper to the paper discharge tray 3, and a plurality of conveying guide ribs 25 for guiding the paper P to the paper discharge roller pair 24. The paper discharge tray 3 is formed in a concave shape at an upper portion of the printer body 2.

When the laser printer 1 receives image data, the photosensitive drum 16 in the image forming unit 8 is rotationally driven and the charging device 17 charges the surface of the photosensitive drum 16 to a positive polarity.

Then, laser light is emitted from the laser scanning unit to the photosensitive drum 16 on the basis of the image data. The laser light is irradiated, so that an electrostatic latent image is formed on the surface of the photosensitive drum 16. The electrostatic latent image formed on the photosensitive drum 16 is developed by toner charged in the developing device 18, so that the electrostatic latent image is visualized as a toner image. In the present embodiment, a toner image is formed by so-called reversal development and the charging polarity of the toner charged in the developing device 18 becomes a positive polarity. It is noted that a toner image may also be formed by normal development as well as the reversal development and in this case, the charging polarity of the toner becomes a negative polarity.

After the toner image is formed on the surface of the photosensitive drum 16, the paper P passes through between the transfer roller 19 and the photosensitive drum 16. When the paper P passes through them, transfer bias having a polarity opposite to the charging polarity of the toner is applied to the transfer roller 19. In this way, the toner image on the photosensitive drum 16 is transferred to the paper P. The paper P with the transferred toner image is heated and pressed by the fixing roller 22 and the pressure roller 23 in the fixing device 9. As a consequence, the toner image is fixed to the paper P. After the toner image is transferred to the paper P from the photosensitive drum 16, remaining toner attached to the surface of the photosensitive drum 16 is removed by the cleaning part 20.

Figure 2:
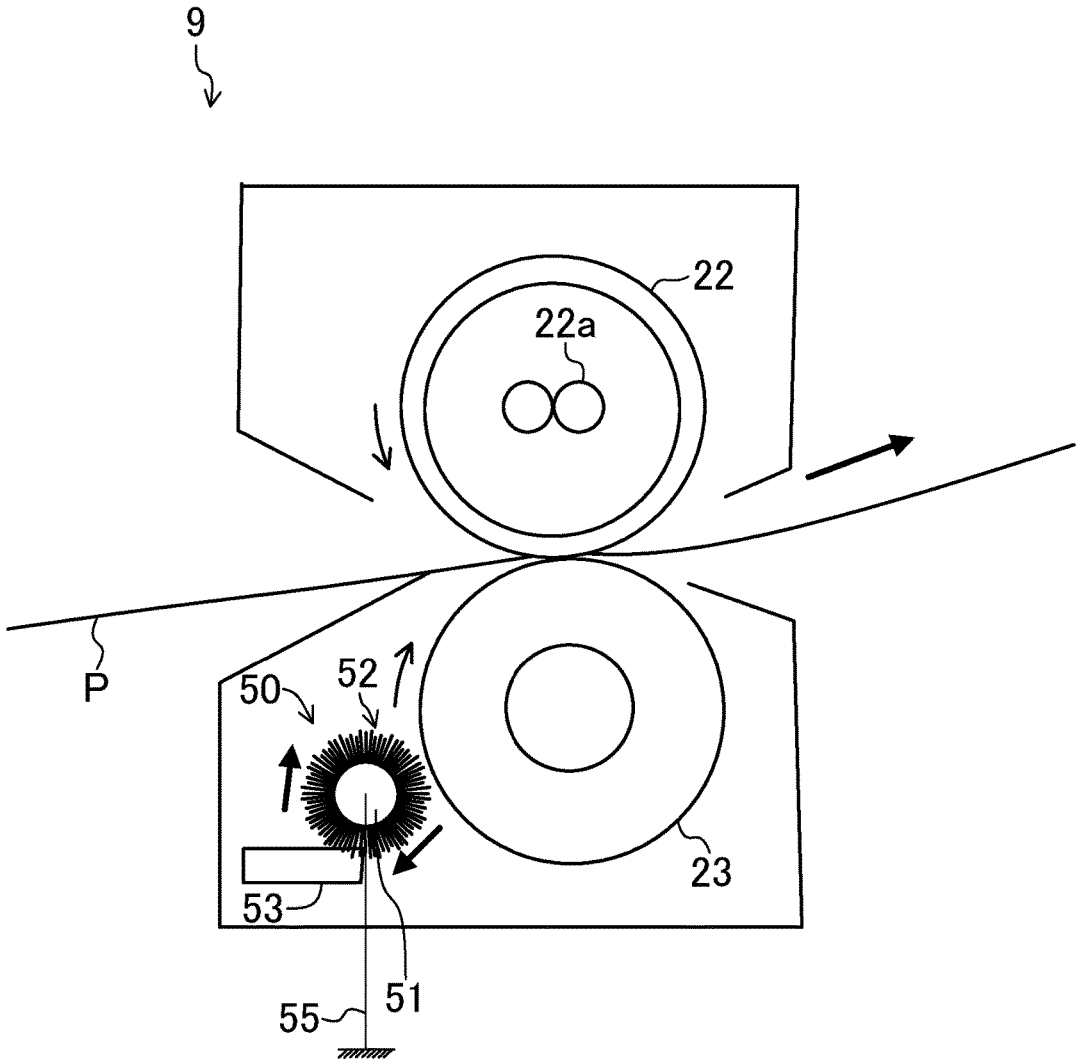
FIG. 2 is an enlarged diagram illustrating a schematic configuration of a fixing device.

As illustrated in FIG. 2, at a lateral side of the pressure roller 23 of the fixing device 9, an electricity removing unit 50 is provided. The electricity removing unit 50 is a device that removes negative polarity charge charged on the surface of the pressure roller 23 by a contact between the pressure roller 23 and the paper P.

Figure 3:
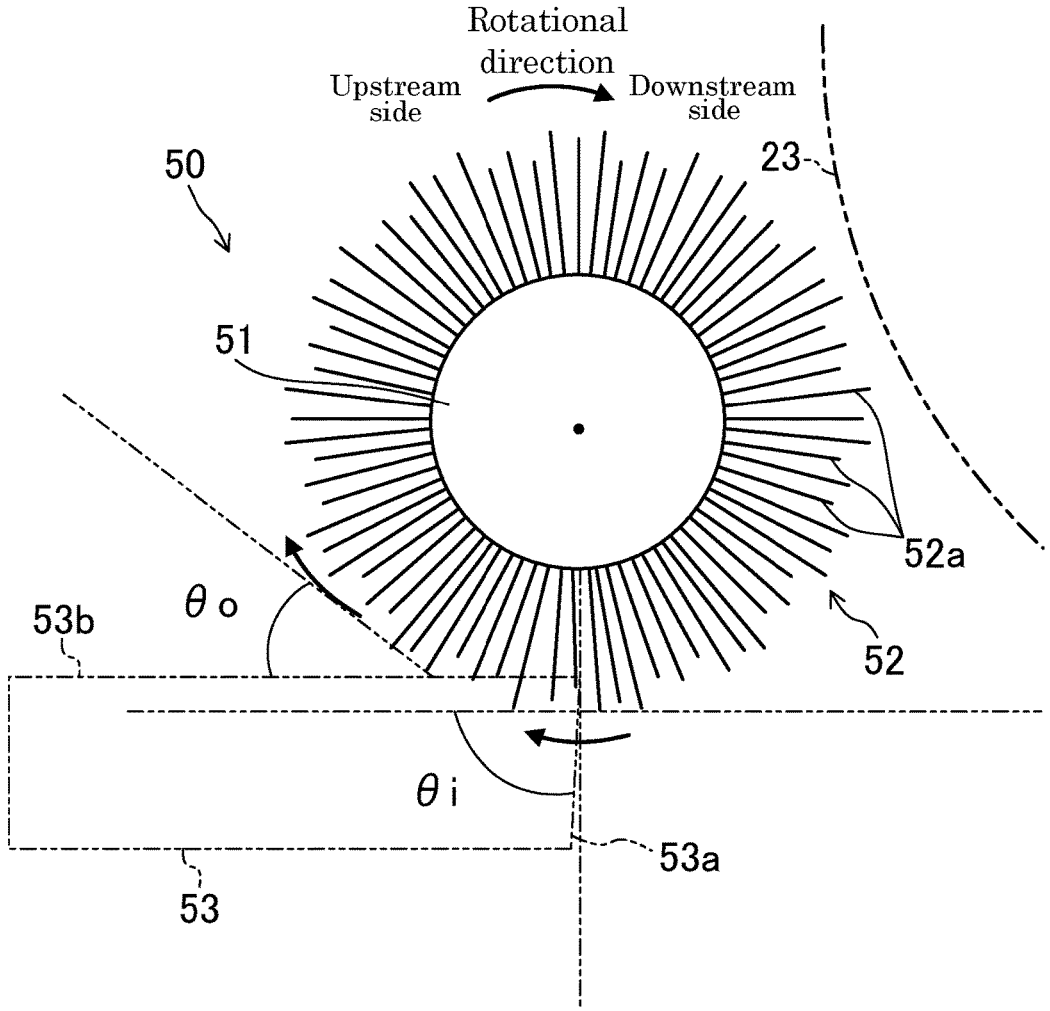
FIG. 3 is an enlarged diagram illustrating an electricity removing brush constituting an electricity removing unit.

As enlarged and illustrated in FIG. 3, the electricity removing unit 50 has a rotating roller part 51, a brush part 52, and a restraint member 53. The rotating roller part 51 is formed in a columnar shape extending in parallel to the pressure roller 23. The rotating roller part 51 is rotationally driven around a shaft of a motor (not illustrated) by the motor.

The brush part 52 is formed over the whole circumference of a peripheral surface of the rotating roller part 51. The brush part 52 includes a plurality of conductive fiber bristles 52*a*. The front ends of the plurality of conductive fiber bristles 52*a* move near the surface of the pressure roller 23 in a tangential direction thereof according to the rotational driving of the rotating roller part 51 by the motor. When the front ends of the plurality of conductive fiber bristles 52*a* move, slight spaces are formed between the front ends of the conductive fiber bristles 52*a* and the surface of the pressure roller 23. Then, discharge occurs between the pressure roller 23 and the front ends of the conductive fiber bristles 52*a*, so that negative polarity charge charged on the surface of the pressure roller 23 is introduced into the rotating roller part 51 through the conductive fiber bristles 52*a*. The charge introduced into the rotating roller part 51 is released to the ground through a grounding wire 55 (illustrated only in FIG. 2).

Preferably, an outer peripheral surface of the brush part 52 has been cut in a cylindrical shape by a tool and the like. In this way, it is possible to constantly maintain distances between the front ends of the conductive fiber bristles 52*a*, which pass through near the surface of the pressure roller 23, and the surface of the pressure roller 23 regardless of the position in an axial direction and the position in a rotational direction of the rotating roller part 51. Accordingly, the distance between the front end of each conductive fiber bristle 52*a* and the surface of the pressure roller 23 is constantly maintained regardless of the position in the axial direction and the position in the rotational direction of the rotating roller part 51, so that it is possible to suppress static elimination unevenness of the surface of the pressure roller 23.

However, at the time of an operation of the fixing device 9, as illustrated in FIG. 3, each conductive fiber bristle 52*a* is pulled to the pressure roller 23 side and is raised by an electric field generated between each conductive fiber bristle 52*a* and the surface of the pressure roller 23. As a consequence, since the distance between the surface of the pressure roller 23 and the front end of each conductive fiber bristle 52*a* varies, it is probable that static elimination unevenness will occur in the surface of the pressure roller 23.

In this regard, in the present embodiment, the restraint member 53 is provided at a lateral side of the pressure roller 23, thereby restraining the distance between the surface of the pressure roller 23 and the front end of each conductive fiber bristle 52*a* to a setting distance (a constant distance) set in advance.

In detail, the aforementioned restraint member 53 is configured by a rectangular plate material extending in parallel to a shaft line of the rotating roller part 51. The restraint member 53 extends over the entire axial direction of the rotating roller part 51 when viewed from a side. The restraint member 53 abuts the conductive fiber bristles 52*a*, which rotate together with the rotating roller part 51, from a downstream side in the rotational direction, thereby inclining the conductive fiber bristles 52*a* to an upstream side from the downstream side in the rotational direction toward a radial outside and thus reforming them (see FIG. 4). The reforming means that each conductive fiber bristle 52*a* is plastically deformed so as not to return to the raised state illustrated in FIG. 3.

When an angle between a right side surface 53*a* (that is, a collision surface with the conductive fiber bristles 52*a*) of the aforementioned restraint member 53 and the rotational tangential direction of the brush part 52 is defined as a brush entrance angle θi and an angle between an upper side surface 53*b* of the restraint member 53 and the rotational tangential direction of the brush part 52 is defined as a brush ejection angle θo, a relation of the brush entrance angle θi>the brush ejection angle θo is satisfied.

Figure 4:
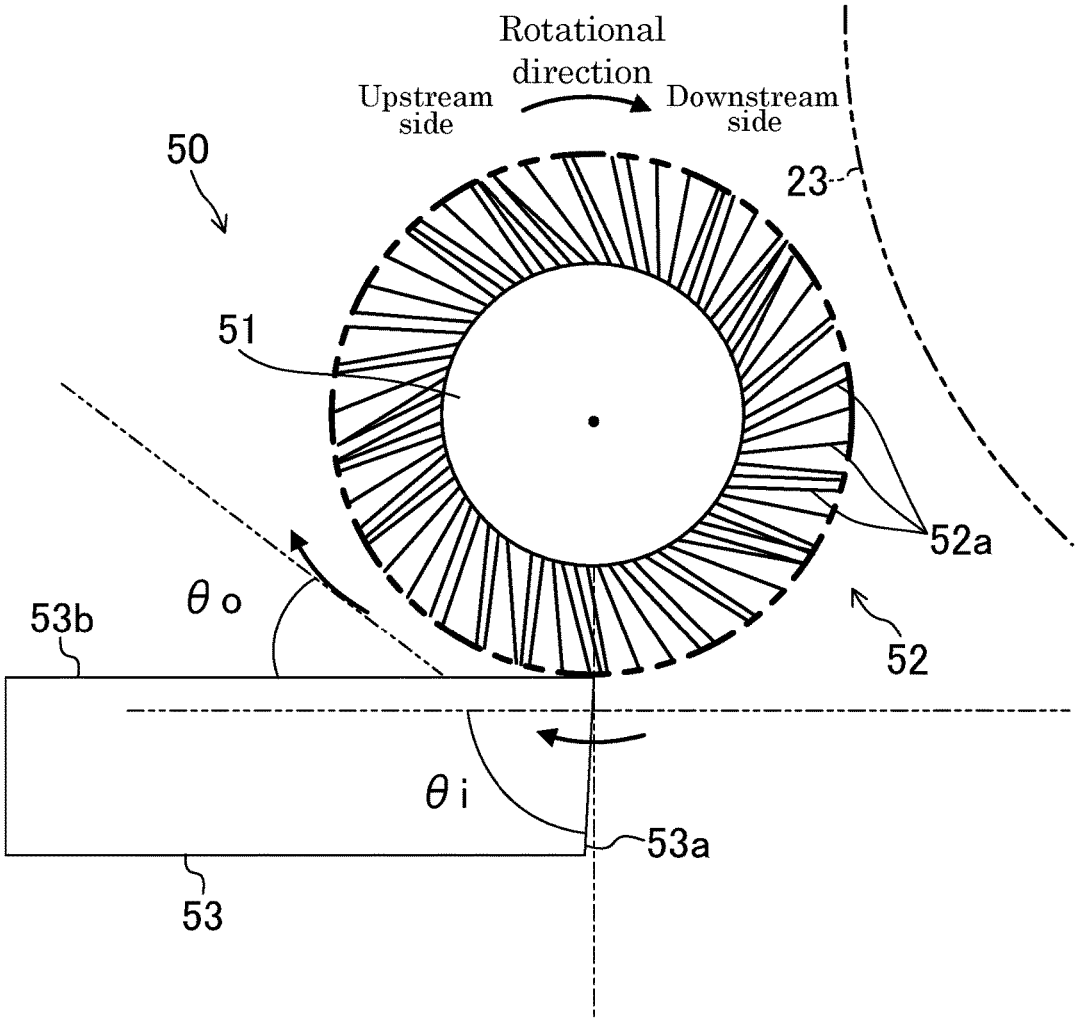
FIG. 4 is a diagram corresponding to FIG. 3, which illustrates the state in which an electricity removing brush has been reformed by a restraint member.

In the fixing device 9 configured as above, at the time of a fixing operation, the rotating roller part 51 is rotationally driven by the motor, so that each conductive fiber bristle 52*a* is reformed by the restraint member 53. As a consequence, as illustrated in FIG. 4, the front end of each conductive fiber bristle 52*a* is positioned on a cylindrical surface employing an axis center of the rotating roller part 51 as a center. Consequently, regardless of the rotation angle of the rotating roller part 51, it is possible to constantly maintain the distance between the surface of the pressure roller 23 and the front end of each conductive fiber bristle 52*a*. Consequently, the amount of discharge between the front end of each conductive fiber bristle 52*a* and the surface of the pressure roller 23 is uniformized, so that it is possible to suppress static elimination unevenness of the surface of the pressure roller 23.

Furthermore, in the aforementioned embodiment, each conductive fiber bristle 52*a* is grounded via the rotating roller part 51 and the grounding wire 55, so that it is possible to reliably release negative polarity charge charged on the surface of the pressure roller 23 to the ground via each conductive fiber bristle.

Furthermore, in the aforementioned embodiment, the relation of the brush entrance angle θi>the brush ejection angle θo is satisfied. Consequently, it is possible to reduce pressure acting on each conductive fiber bristle 52*a* when the brush part 52 escapes from the restraint member 53 while sufficiently ensuring collision force between each conductive fiber bristle 52*a* of the brush part 52 and the restraint member 53. Thus, it is possible to prevent the deterioration of durability of each conductive fiber bristle 52*a* while reliably performing the reforming of each conductive fiber bristle 52*a*.

Example

Figure 5:
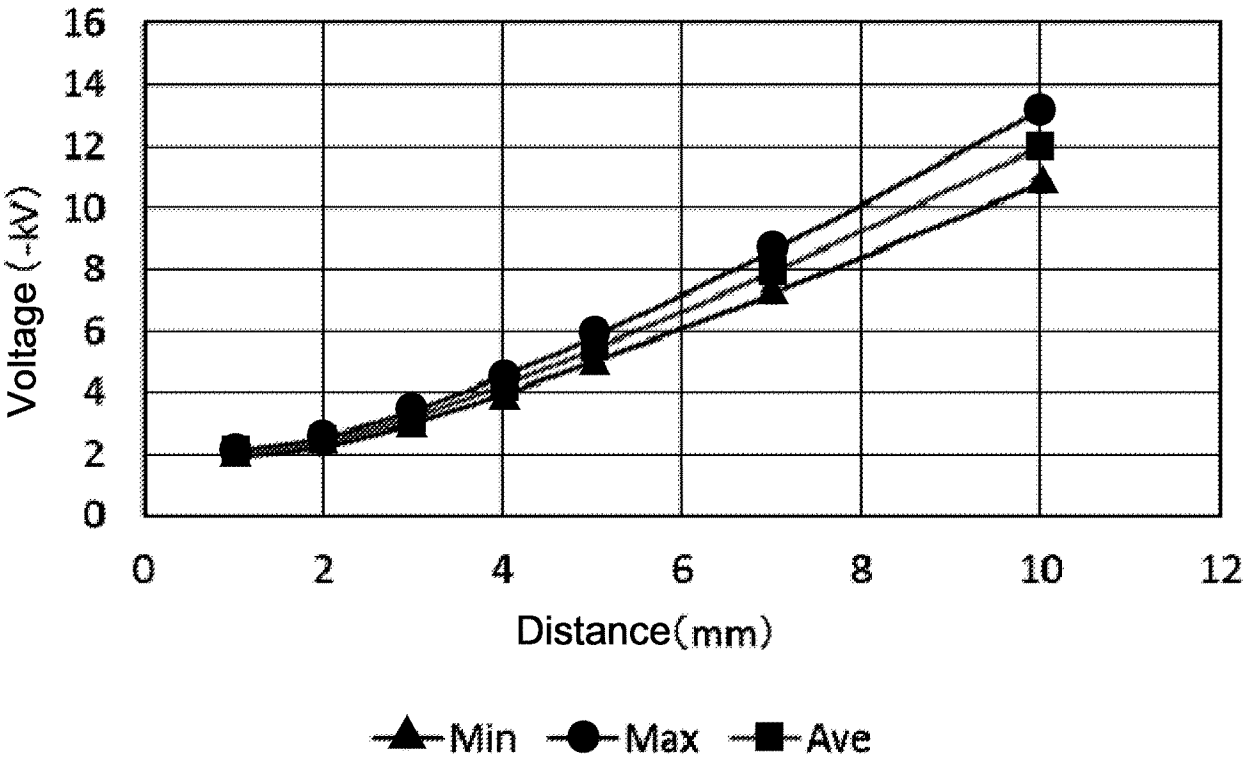
FIG. 5 is a graph illustrating a result obtained by measuring the surface potential of a pressure roller by variously changing a discharge distance by using a fixing device of an example.

FIG. 5 is a graph illustrating a result obtained by measuring the surface potential of the pressure roller 23 by variously changing a discharge distance by using the fixing device 9 of the aforementioned embodiment. Herein, the discharge distance is a distance obtained by subtracting a fiber length of the conductive fiber bristle 52*a* from an interaxial distance between the rotating roller part 51 and the pressure roller 23.

In this experiment, a-Si photosensitive drum 16 of ϕ 30 mm has been rotationally driven at a linear velocity of 300 mm/s. As the heater 22*a* of the fixing roller 22, a halogen heater has been employed. The fixing roller 22 has been formed by stacking a conductive adhesive layer and an insulating release layer on an outer peripheral surface of an aluminum pipe having an outer diameter of ϕ 30 mm and a thickness of 0.55 mm and by stacking a heat absorbing layer on an inner peripheral surface of the aluminum pipe. The pressure roller has been formed by stacking a silicon rubber layer, an adhesive layer, and a fluororesin film layer on an outer peripheral surface of a cored bar of ϕ 12 mm. The fiber length of each conductive fiber bristle 52*a* of the brush part 52 provided on an outer peripheral surface of the rotating roller part 51 has been set to 3 mm and a gap distance between the front end of each conductive fiber bristle 52*a* and the surface of the pressure roller 23 has been set to 2 mm. Each conductive fiber bristle 52*a* has been configured to be grounded via the rotating roller part 51 and the grounding wire 55. A cut-in depth (an overlap amount between the restraint member 53 and the brush part 52) of the restraint member 53 with respect to the brush part 52 has been set to about 1 mm. Furthermore, the brush entrance angle θi for the restraint member 53 has been set to 85° and the brush ejection angle θo has been set to 40°.

Figure 6:
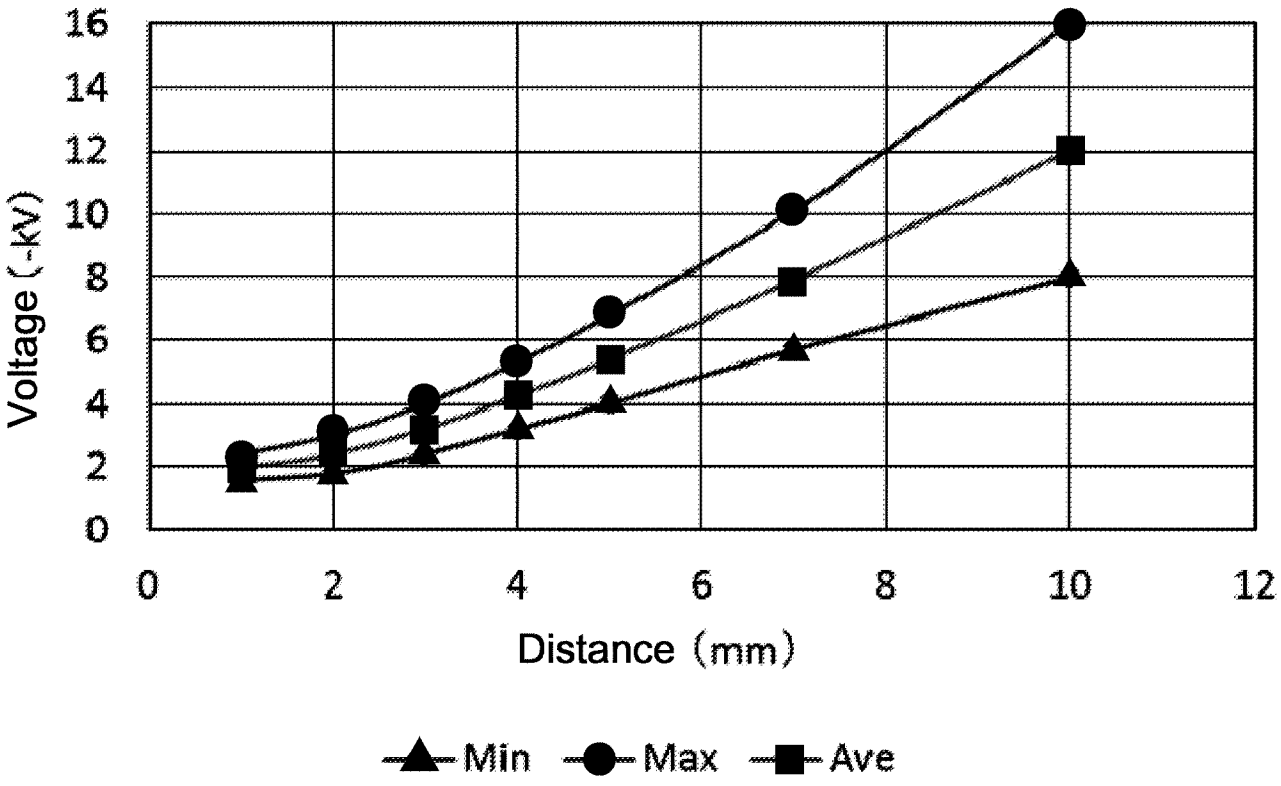
Fig.6 Prior Art
FIG. 6 is a diagram corresponding to FIG. 5, which illustrates a conventional example.

FIG. 6 is a graph illustrating a result obtained by performing a similar experiment by using a conventional fixing device 9 having no restraint member 53. In FIG. 5 and FIG. 6, "Min" indicates a minimum value of the measured surface potentials of the pressure roller 23, "Max" indicates a maximum value of the measured surface potentials of the pressure roller 23, and "Ave" indicates an average value of the measured surface potentials of the pressure roller 23.

When the experimental results of the example (FIG. 5) and the conventional example (FIG. 6) are compared with each other, it can be understood that a width between the minimum value and the maximum value of the surface potentials of the pressure roller 23, that is, static elimination unevenness of the surface of the pressure roller 23 is reduced in the example having the restraint member 53, as compared with the conventional example having no restraint member 53.

Other Embodiments

In the aforementioned embodiment, the example, in which each conductive fiber bristle 52*a* is grounded via the rotating roller part 51, has been described; however, the technology of the present disclosure is not limited thereto and each conductive fiber bristle 52*a* may be charged to a polarity (that is, a positive polarity) opposite to that of charge on the surface of the aforementioned pressure roller 23 by applying a bias voltage to each conductive fiber bristle 52*a*. Furthermore, the photosensitive drum 16 and the charging polarity of toner are not respectively limited to the aforementioned example.

What is claimed is:

1. A fixing device including a fixing roller, a pressure roller brought into press contact with the fixing roller, and an electricity removing unit for removing charge charged on a surface of the pressure roller, wherein the electricity removing unit comprises:

a rotatable rotating roller part;

a brush part including a plurality of conductive fiber bristles having base end portions connected to a peripheral surface of the rotating roller part;

a driving part that rotationally drives the rotating roller part; and a restraint member that abuts the brush part from a rotation downstream side to restrain a distance between a front end of each conductive fiber bristle and the peripheral surface of the rotating roller part to a setting distance set in advance.

2. The fixing device of claim 1, wherein, when an angle between an entrance side surface of the brush part and a rotational tangential direction of the brush part in the restraint member is defined as a brush entrance angle θi and an angle between an ejection side surface of the brush part and the rotational tangential direction of the brush part in the restraint member is defined as a brush ejection angle θo, a relation of θi>θo is satisfied.

3. The fixing device of claim 1, wherein each conductive fiber bristle is grounded or receives a bias voltage so as to be charged to a polarity opposite to a polarity of charge on the surface of the pressure roller.

4. An image forming apparatus including the fixing device of claim 1.

* * * * *